United States Patent [19]

Aldinger et al.

[11] 4,448,351

[45] May 15, 1984

[54] WATER FAUCET MODIFYING APPARATUS

[76] Inventors: Darrell D. Aldinger, 2211 Green Terrace Dr.; Roger B. Van Wagoner, 2309 Wyoming Ave., both of Billings, Mont. 59102

[21] Appl. No.: 462,040

[22] Filed: Jan. 28, 1983

Related U.S. Application Data

[63] Continuation-in-part of Ser. No. 278,750, Jun. 29, 1981, abandoned.

[51] Int. Cl.[3] ..... B05B 1/16

[52] U.S. Cl. ..... 239/25; 239/447

[58] Field of Search ..... 239/25, 443, 444, 446, 239/447

[56] References Cited

U.S. PATENT DOCUMENTS

| | | | |
|---|---|---|---|
| 3,030,029 | 4/1962 | Slater, Jr. | 239/25 |
| 3,062,452 | 11/1962 | Knight | 239/25 |
| 3,118,605 | 1/1964 | McClenahan | 239/443 X |
| 3,265,307 | 8/1966 | Slater, Jr. | 239/25 |

*Primary Examiner*—John J. Love
*Assistant Examiner*—Mary F. McCarthy
*Attorney, Agent, or Firm*—Arthur L. Urban

[57] ABSTRACT

Water faucet modifying apparatus including a housing, a main passage with an inlet and an outlet extending through the housing, an aerator connected with the outlet, a side passage in the sidewall of the housing communicating with the main passage intermediate the inlet and outlet, a conduit extending from the side passage outlet in the direction of the inlet, diverter mechanism disposed within the housing adjacent the intersection of the side passage with the main passage thereof, the diverter mechanism including a valve stem member extending into the main passage transversely thereto, the stem member including an actuator portion extending through the sidewall of the housing, a seal disposed on the opposite end of the stem member engageable with the side passage, a first barrier section disposed across the main passage between the stem member and the outlet of the main passage, the first barrier section including an opening therethrough at a point adjacent the stem member opening in the housing sidewall, a second barrier section across the main passage between the stem member and the inlet of the main passage, the second barrier section including an opening therethrough at a point adjacent the side passage, a connector plate section extending between the first and second barrier sections and dividing the space therebetween into two chambers, the connector plate section including an opening therethrough, the stem member extending through the connector plate opening, biasing mechanism urging the stem member toward the side passage.

15 Claims, 4 Drawing Figures

WATER FAUCET MODIFYING APPARATUS

This application is a continuation-in-part of pending application Ser. No. 278,750, filed June 29, 1981, now abandoned.

This invention relates to a novel faucet modifying apparatus and more particularly relates to a new apparatus for modifying the flow of water from a faucet.

A wide variety of controls have been employed through the years to regulate the flow of fluids through conduits. Controls are used generally to regulate the flow of many kinds of fluids including gases and liquids.

One common means for controlling flow is the use of valves in domestic water systems. Valves are utilized both in the main distribution lines and in the plumbing facilities of dwellings and other buildings. Many valves and particularly faucets are employed throughout home water systems.

The design of faucets has not changed significantly through the years. Most of the changes have been in the appearance of the faucets to make them more aesthetically pleasing. One of the few functional changes in faucet design has been the so-called single control faucet. This faucet, as its name indicates, uses one valve to mix and control both the hot and cold water. Many of these faucets are of washerless construction.

Another functional modification of faucets is the aerating spout. This accessory includes a series of screens and diffusors disposed within a sleeve connectable to the end of the faucet spout. Generally, the aerator is threadedly attached to the spout.

The water that is dispensed from the faucet ordinarily is collected in some type of vessel. If the water is to be employed for washing, the water may be collected in a wash basin or sink with which the faucet is associated. For cooking purposes, the water may be collected in a cooking pan.

When the water is for drinking, the water usually is collected in a glass or cup. One of the problems with drinking from a glass or cup is being sure that the drinking vessel is clean. A fresh glass can be used each time a drink of water is taken, however, the number of used glasses that would accumulate each day would be substantial, particularly in families with several children. The accumulation of these glasses not only presents a dishwashing problem, but also the inconvenience of finding a place to store all of the used glasses between washings.

To minimize the accumulation of used drinking glasses, each person in a household simply may use the same glass a number of times before changing it. For example, some persons change the glass each day or some other period and rely on their rinsing of the glass each time before taking a drink for cleanliness.

An alternative to using the same glass for a selected time period is to use disposable drinking vessels such as paper or plastic cups. A difficulty with this solution is finding a place to store a supply of cups close to the water faucet. Some people place a stack of nested cups on the counter adjacent to the faucet. Others utilize wall-mounted dispensers. Another problem created by the use of disposable cups is finding a place for a receptacle for the discarded cups.

A further problem with disposable cups especially where children are involved is making sure that the used cups are properly placed into a container. The used cups may become a play object such as a ball to be thrown at the receptacle like a basketball. If the cup misses its target, the child may be tempted to walk away without picking it up from the floor and placing it into the container properly.

Another factor to be considered in the use of single use drinking containers is the cost. With a multiperson family, the expense of disposable cups can be substantial. Alternatively, the extra expense of washing a large number of drinking glasses either by hand or in a dishwasher can be significant.

From the above discussion, it is apparent that individuals making a decision on the type of a drinking vessel to use are faced with a number of choices. For most people the choices represent compromise solutions that are less than ideal. Thus, there is a need for a new means for drinking water in a home.

The present invention provides a novel apparatus for modifying a water faucet. The faucet apparatus of the invention provides a simple and convenient way to drink water. The apparatus provides a sanitary means for drinking water without the use of a drinking vessel. Thus, the apparatus eliminates the need for disposable cups or the washing of a large number of drinking vessels.

The faucet modifying apparatus of the present invention is simple in design and can be produced relatively inexpensively. The apparatus can be fabricated from commercially available materials and components employing conventional faucet manufacturing techniques and procedures.

The apparatus can be installed in a few minutes by persons with limited plumbing aptitude and/or experience and without special tools. The apparatus is durable in construction and has a long useful life with little if any maintenance.

Other benefits and advantages of the novel faucet modifying apparatus of the present invention will be apparent from the following description and the accompanying drawings in which.

Figure 1:
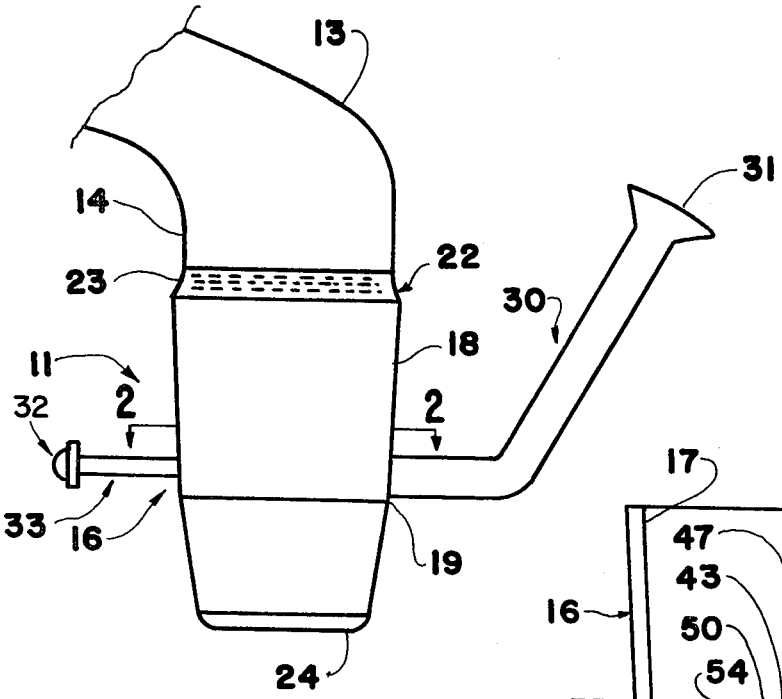
FIG. 1 is a side view of one form of the faucet modifying apparatus of the invention mounted on a faucet.
Figure 2:
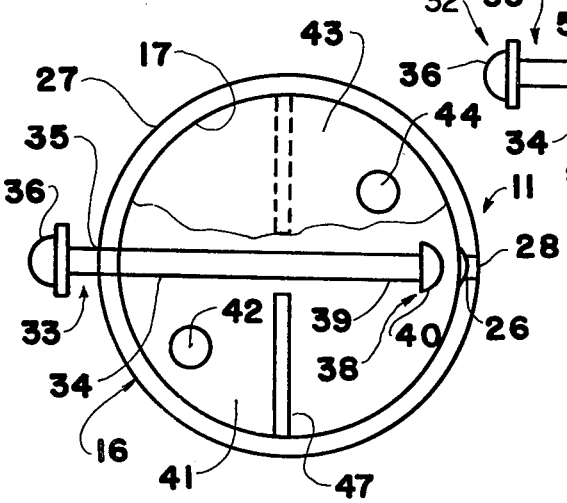
FIG. 2 is a sectional view taken along line 2—2 of FIG. 1.
Figure 3:
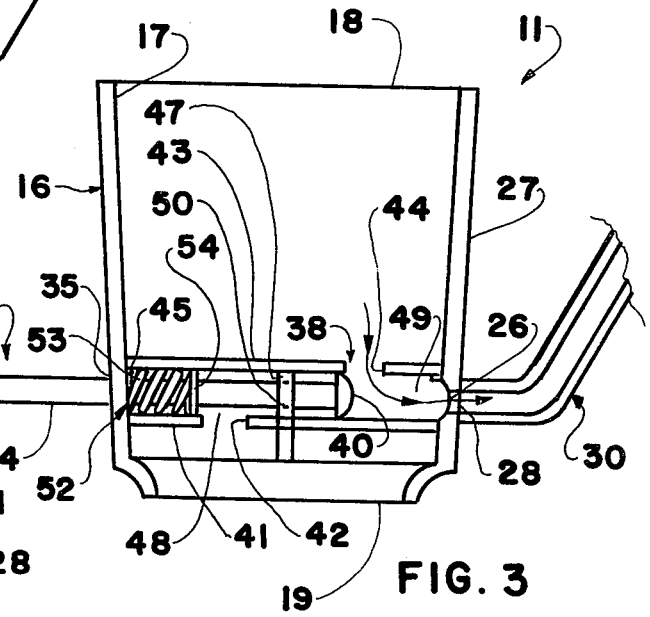
FIG. 3 is an enlarged fragmentary side view in section of the faucet modifying apparatus of FIG. 1 shown in a drinking position.
Figure 4:
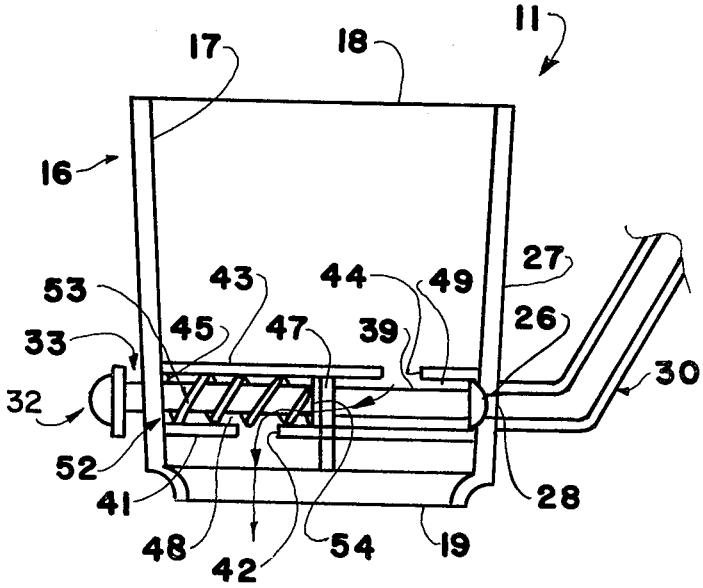
FIG. 4 is an enlarged fragmentary side view in section of the faucet modifying apparatus of FIG. 1 shown in a non-drinking position.

As shown in the drawings, one form of the faucet modifying apparatus 11 of the present invention is attached to a faucet (not shown) including an outlet spout 13. The apparatus 11 may be attached to the spout 13 by a variety of means. Advantageously, the apparatus is attached to a threaded outlet opening 14 of the spout 13. Such a threaded opening commonly is utilized for the attachment of an aerator (not shown) to the spout 13.

The apparatus 11 includes a housing 16 with a main passage 17 therethrough. Passage 17 includes an inlet 18 at one end thereof, advantageously at the upper end as shown. The main passage 17 also includes an outlet 19 at the opposite end of the passage from the inlet 18. Preferably, the main passage is a substantially straight passage.

Removable connector means 22 is associated with the inlet opening 18 of the main passage 17. The connector means 22 secures the housing 16 to water faucet spout opening 14. The connector means 22 may take a variety of forms including a threaded section 23. Aerator means 24 is associated with the outlet 19.

A side passage 26 is located in the sidewall 27 of the housing 16. The side passage 26 communicates with the main passage 17 intermediate the inlet 18 and the outlet 19. The side passage 26 has an outlet 28 at the periphery of the housing 16.

A conduit 30 is affixed to the side passage outlet 28. The conduit 30 extends from the side passage outlet 28 at an angle to the housing 16. The conduit 30 extends in the direction of the inlet opening 18. The conduit 30 includes an outlet 31 at the free end thereof.

Diverter means 32 is disposed within the housing 16 adjacent the intersection of the main passage 17 with the side passage 26. The diverter means 32 includes a valve stem member 33. The valve stem member 33 extends into the main passage 17 and transversely thereto.

The valve stem member 33 includes an actuator portion 34 that extends through an opening 35 in the sidewall 27 of the housing 16. Advantageously, the stem member 33 is disposed substantially perpendicular to the main passage 17. The portion 34 of the stem member extending outside the housing preferably includes an enlarged end section 36.

Sealing means 38 is disposed on the free end 39 of the stem member 33. The sealing means 38 is engageable with the side passage 26 at the intersection thereof with the main passage 17. The sealing means 38 on the free end of the stem member 33 advantageously includes a rubber bushing 40 positioned on the free end of the stem member.

A first barrier section 41 is disposed across the main passage 17 between the stem member 33 and outlet 19 of the main passage 17. The first barrier section 41 includes an opening 42 therethrough. The opening 42 is located at a point adjacent the stem member opening 35 in the sidewall of the housing. Advantageously, the first barrier section 41 is disposed adjacent the outlet 19 of the main passage. Preferably, the first barrier section 41 is affixed within the main passage 17.

A second barrier section 43 is disposed across the main passage 17 between the stem member 33 and the inlet 18 of the main passage. The second barrier section 43 includes an opening 44 therethrough. The opening 44 is located at a point adjacent the side passage 26.

The second barrier section 43 preferably is supported on means such as flange 45 extending inwardly into the main passage. The distance between the first and second barrier sections 41 and 43 advantageously is less than the width of the main passage 17.

A connector plate section 47 joins the first and second barrier sections 41 and 43. The connector plate section 47 divides the space between the first and second barrier sections into two chambers 48 and 49. The connector plate section 47 includes an opening 50 therethrough. Stem member 33 extends through opening 50 which is significantly larger than the stem member. The plate section 47 advantageously is disposed adjacent the axis of the main passage 17.

Biasing means 52 urges the stem member 33 toward the side passage 26. Preferably, the biasing means 52 includes a coil spring 53 that is disposed over the stem member. Advantageously, the coil spring 53 extends from the sidewall 27 of the housing 16 adjacent the actuator portion 34 of the stem member. Preferably, the opposite end of the coil spring 53 bears against stop means 54 located along the length of the stem member.

The faucet modifying apparatus 11 of the invention may be fabricated from any of a number of different materials such as metals, plastics and the like. Advantageously, the housing 16 is a unitary structure and preferably a structure molded of a plastic material. The connector 22, the aerator 24 and the diverter 32 may be formed of plastic or metal as desired.

In the operation of the faucet modifying apparatus 11 of the invention as shown in the drawings, the apparatus is attached to the faucet outlet spout 13 by securing connector 22 to the spout. The connector 22 may include a threaded section 23 which engages the threaded outlet opening 14 of the spout. The apparatus now is ready for use.

The valve of the faucet (not shown) is opened allowing water to flow into main passage 17. The water then flows through opening 44 in the second barrier section 43 and into chamber 49. Since spring 53 is urging bushing 40 on the end of the stem member 33 against the side passage 26 at the intersection thereof with the main passage 17, the water will pass through opening 50 of the connector plate member 47 and into chamber 48. From chamber 48, the water flows through opening 42 of first barrier section 41 and exits through outlet 19.

When a person wishes to drink from the apparatus 11, he simply pulls valve stem member 33 outwardly by grasping enlarged end section 36 thereof. This action causes the bushing 40 on the opposite end of the stem member to seal against the opening 50 in the connector plate section 47 by the pressure of the water in chamber 49 against the bushing.

Thus, water entering chamber 49 through opening 44 flows out the open side passage 26 and conduit 30. The water flowing through conduit 30 exits via outlet 31 thereof. A person drinking simply places his mouth close to the exiting water in the conventional manner.

The valve stem member 33 returns the apparatus 11 to the normal flow pattern when the faucet valve is shut off. This action causes the water pressure against bushing 40 to be dissipated so that spring 53 will force the stem member bushing 40 against the side passage 26 at the intersection thereof with the main passage 17 and seals off the side passage. This same movement can be achieved if desired by manually pushing the end section 36 of the stem member toward the housing sidewall 27.

The above description and the accompanying drawings show that the present invention provides a novel faucet modifying apparatus which simplifies drinking water. The apparatus of the invention eliminates the need for a drinking vessel. The apparatus provides a sanitary means for drinking water without the use of a fresh drinking vessel for each drink. As a consequence, the use of disposable drinking cups and the problems associated with their use is eliminated. Also, the problems in the utilization of fresh drinking glasses that have to be washed after use are obviated.

The faucet modifying apparatus of the invention is simple in design and convenient to use. The apparatus can be produced relatively inexpensively with commercially available materials and components. Conventional valve and faucet manufacturing procedures may be utilized in its fabrication.

The apparatus of the invention can be installed easily by individuals with limited plumbing experience or aptitude. The apparatus can be installed in only a few minutes and can be transferred from one faucet to another easily without special tools. The apparatus is durable in construction and has a long useful life with little if any maintenance.

It will be apparent that various modifications can be made in the particular faucet modifying apparatus described in detail and shown in the drawings within the scope of the invention. The size, configuration and arrangement of components can be different to meet specific requirements. For example, the location of the free end of the spout can be changed if desired. The above and other changes may be made provided the functioning and operation of the apparatus are not deleteriously affected. Therefore, the scope of the present invention is to be limited only by the following claims.

What is claimed is:

1. Water faucet modifying apparatus including a housing, a main passage extending through said housing, an inlet at one end of said main passage, an outlet at the opposite end of said main passage, removable connector means extending from said inlet for securing said inlet to a water faucet spout, aerating means connected with said outlet, a side passage in the sidewall of said housing communicating with said main passage intermediate said inlet and outlet, said side passage having an outlet at the periphery of said housing, a conduit extending from said side passage outlet in the direction of said inlet, said conduit including an outlet at the free end thereof, diverter means disposed within said housing adjacent the intersection of said side passage with said main passage thereof, said diverter means including a valve stem member extending into said main passage transversely thereto, said stem member including an actuator portion extending through the sidewall of said housing, sealing means disposed on the opposite end of said stem member, said sealing means being engageable with said side passage at the intersection thereof with said main passage, a first barrier section disposed across said main passage between said stem member and said outlet of said main passage, said first barrier section including an opening therethrough at a point adjacent said stem member opening in said housing sidewall, a second barrier section across said main passage between said stem member and said inlet of said main passage, said second barrier section including an opening therethrough at a point adjacent said side passage, a connector plate section extending between said first and second barrier sections, said connector plate section dividing the space between said barrier sections into two chambers, said connector plate section including an opening therethrough, said stem member extending through said connector plate opening, biasing means urging said stem member toward said side passage.

2. Water faucet modifying apparatus according to claim 1 wherein said main passage is substantially straight.

3. Water faucet modifying apparatus according to claim 1 wherein said housing is formed of a plastic material.

4. Water faucet modifying apparatus according to claim 1 wherein said connector means includes a threaded section.

5. Water faucet modifying apparatus according to claim 1 wherein said stem member is disposed substantially perpendicular to said main passage.

6. Water faucet modifying apparatus according to claim 1 wherein the portion of said stem member extending outside said housing has an enlarged end section.

7. Water faucet modifying apparatus according to claim 1 wherein said stem member includes stop means for said biasing means disposed along the length thereof.

8. Water faucet modifying apparatus according to claim 1 wherein said sealing means on the end of said stem member is movable between said side passage and said opening in said connector plate section.

9. Water faucet modifying apparatus according to claim 1 wherein said sealing means includes a rubber bushing positioned on the free end of said stem member.

10. Water faucet modifying apparatus according to claim 1 wherein said first barrier section is disposed adjacent to said main passage outlet.

11. Water faucet modifying apparatus according to claim 1 wherein said first barrier section is affixed within said main passage.

12. Water faucet modifying apparatus according to claim 1 wherein said second barrier section is supported on means extending inwardly into said main passage.

13. Water faucet modifying apparatus according to claim 1 wherein the distance between said first and second barrier sections is less than the width of said main passage.

14. Water faucet modifying apparatus according to claim 1 wherein said collector plate section is disposed adjacent the axis of said main passage.

15. Water faucet modifying apparatus according to claim 1 wherein said biasing means includes a coil spring disposed over said stem member.

* * * * *